US006302268B1

(12) United States Patent
Michaeli

(10) Patent No.: US 6,302,268 B1
(45) Date of Patent: Oct. 16, 2001

(54) SALAD CONTAINER HAVING INSERT CHAMBER

(76) Inventor: Daniel Reuven Michaeli, Section 1307/GUA, Box 02-5289, Miami, FL (US) 33102-5289

( * ) Notice: Subject to any disclaimer, the term of this patent is extended or adjusted under 35 U.S.C. 154(b) by 0 days.

(21) Appl. No.: 09/718,700

(22) Filed: Nov. 24, 2000

(51) Int. Cl.[7] ..... B65D 25/08
(52) U.S. Cl. ..... 206/221; 220/521; 215/DIG. 8
(58) Field of Search ..... 206/221, 219; 215/DIG. 8; 220/521

(56) References Cited

U.S. PATENT DOCUMENTS 4,634,003 * 1/1987 Ueda et al. ..... 206/221
4,793,475 * 12/1988 Itzel ..... 206/221
5,128,104 * 7/1992 Murphy et al. ..... 206/221
5,944,175 * 8/1999 Albisetti ..... 206/221
5,997,814 * 12/1999 Mingrovic et al. ..... 206/221

* cited by examiner

*Primary Examiner*—Joseph M. Moy
(74) *Attorney, Agent, or Firm*—Charles E. Baxley, Esq.

(57) ABSTRACT

A container for salad includes a base, a removable cover and a chamber insert which projects through the cover and into the container. The container is sealed by a removable cap. Pressure applied by a user to a portion of the chamber insert releases the cap and allows salad dressing which is stored in an enclosure in the chamber member to flow onto salad ingredients which are in the base. Shaking the container facilitates uniform mixing of the salad dressing with the salad ingredients.

17 Claims, 4 Drawing Sheets

SALAD CONTAINER HAVING INSERT CHAMBER

BACKGROUND OF THE INVENTION

Field of the Invention

The present invention relates generally to food containers and more particularly to a salad container with an insert chamber for salad dressing.

Prior art relates to containers for storing and transporting salads and includes various conventional containers which are generally bowl-like and relatively shallow in configuration. Salad dressing which is sold along with the salad typically is provided in a small cylindrical container, about the size of a shot glass, which is placed in the bowl-like container along with the salad ingredients. During transportation the salad dressing container is free to move within the bowl-like container and the salad dressing container often opens thereby coating the salad ingredients, causing them to wilt and become unappetizing.

An additional problem of the prior art typically occurs when a bowl-like salad container is opened and it is desired to mix the salad dressing and the other salad ingredients. The generally shallow bowl-like configuration of the conventional salad container often causes awkwardness in a mixing process resulting in uneven mixing of the dressing with the other salad ingredients. Spillage of various ingredients can result therefrom.

OBJECTS AND SUMMARY OF THE INVENTION

It is an object of the present invention to provide a salad container with an chamber insert which can be used to store conveniently and transport salad ingredients and salad dressing without unwanted mixing prior to use.

Another object of the present invention is to provide a salad container with a chamber insert that can be used to mix salad ingredients and salad dressing in a neat and efficient manner prior to ingestion.

Another object the present invention is to provide a salad container with a chamber insert which can be used to serve mixed salad in a convenient manner.

Another object of the present invention is to provide a salad container with a chamber insert which keeps salad ingredients crisp and free of dressing until they are ready to be eaten.

Another object of the present invention is to provide a salad container with a chamber insert which can be used to mix the salad ingredients and the dressing by shaking.

Another object of the present invention is to provide a salad container with a chamber insert which facilitates uniform mixing of th salad ingredients and the salad dressing.

Another object of the present invention is to provide a salad container with a chamber insert which prevents spillage of salad ingredients.

Yet another object of the present invention is to provide a salad container which includes a relatively small number of component parts, each of which can be manufactured economically in volume resulting in a low overall cost.

The foregoing and other objects and advantages of the present invention will appear more clearly hereinafter.

In accordance with the present invention there is provided a salad container having a chamber insert which container includes: a container base, a removable container cover, a chamber insert and a removable cap which seals an enclosure in the chamber insert. The chamber insert projects through an opening in the container cover. The cap includes a shaft, the end of which projects proximate to a central portion of the chamber insert. Pressure applied by a user to a central flexible portion of the chamber insert applies a force to the shaft which releases the cap from the chamber insert and allows salad dressing, which is stored in the enclosure in the chamber insert, to flow onto salad ingredients in the container. Shaking the salad container facilitates efficient and uniform mixing of the salad ingredients with the salad dressing.

DESCRIPTION OF DRAWINGS

The foregoing and other objectives and advantages of the present invention will appear more fully from a detailed description thereof which follows. The description should be read in conjunction with accompanying drawings, in which.

DETAILED DESCRIPTION OF THE INVENTION

Figure 1:
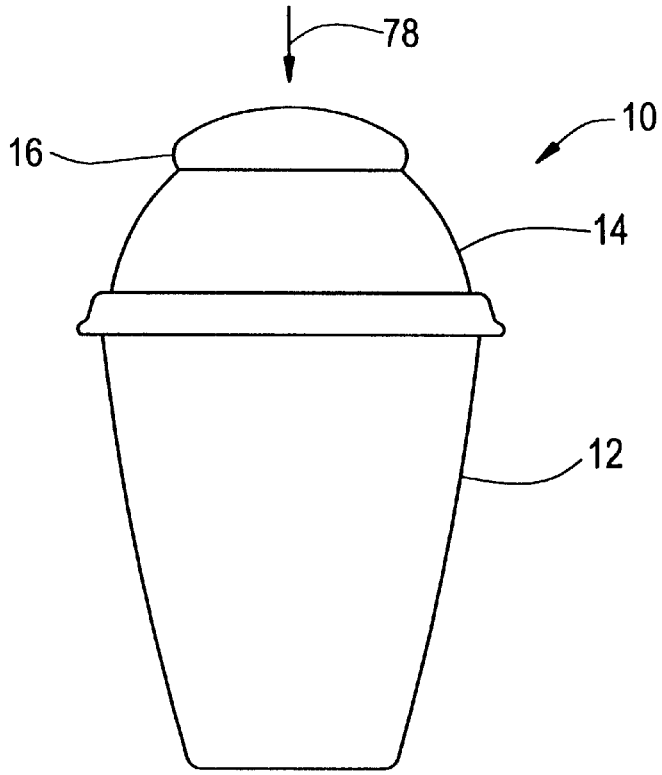
FIG. 1 is a side elevational view of a salad container having an internal chamber made in accordance with the present invention.
Figure 2:
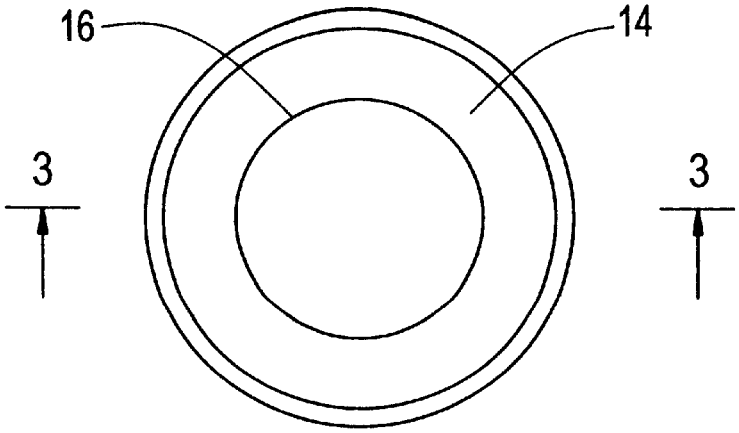
FIG. 2 is a top plan view of the salad container of FIG. 1.

With reference to the drawings, wherein like reference numbers designate like or corresponding parts throughout, there is shown a salad container generally designated 10 having a dressing enclosure 15 in a dressing chamber insert 16 made in accordance with the present invention.

The salad container 10 includes a container base 12, a container cover 14, the dressing chamber insert 16 and a dressing chamber cap 18. The container base 12 is generally cup-shaped in configuration typically having an outwardly directed circular rim 20 formed at an upper edge 22 of the chamber base 12. The container base 12 as well as the container cover 14 and the dressing chamber insert 16 are generally radially symmetrical about an imaginary central axis, thereby facilitating economical manufacture.

The container cover 14 is generally dome-shaped with a centrally located inwardly directed portion 24. The inwardly directed portion 24 is funnel-shaped in configuration. A lower portion 26 of the cover 14 includes an outwardly projecting rim 28 which is spaced away from a skirt portion 30 the lower edge 32 of which extends below the rim 28. Edge 32 of the skirt portion 30 helps guide the cover 14 onto the container base 12. When the cover 14 is in place on the container base 12, an upper edge 34 of the base 12 enters a space 36 formed between the rim 28 and the skirt portion 30.

The rim 28 and skirt portion 30 of the cover 14 cooperate to form an effective snap-fit seal which prevents the cover 14 from being dislodged accidentally from the base 12 and prevents unwanted spilling of contents of the salad container 10. The skirt portion 30 allows the cover 14 to be engaged quickly onto the base 12 and the rim 28 enables a user quickly and easily to remove the cover 14 when desired.

The dressing chamber insert 16 defines the enclosure 15 and is generally mushroom-shaped in configuration with a dome-shaped cap portion 38 which fits over and completely closes the inwardly directed portion 24 of the cover 14. A lower portion 40 of the dressing chamber insert 16 is generally funnel-shaped in configuration and a wall 42 of the lower portion 40 conforms to the funnel shape of the inwardly directed portion 24 of the cover 14. In the preferred embodiment, a wall 46 of the inwardly directed portion 24 of the cover 14 is concave while the wall 42 of the lower portion 40 of the dressing chamber insert 16 is convex.

A lower portion 48 of the portion 40 of the dressing chamber insert 16 leads to a cylindrical portion 50 which projects downwardly past a lower edge 52 of the portion 24. A lower edge 54 of the cylindrical portion 40 has an outwardly directed rim 56 which cooperates with the cap 18 to hold the cap 18 closed.

An upper portion 58 of the cylindrical portion 40 includes a rim 60 which, during installation of the dressing chamber insert 16, is forced past a bottom end 62 of the central portion 24 of the cover 14. The rim 60 locks the dressing chamber insert 16 in place on the cover 14.

The dressing chamber insert 16 preferably is fabricated of a flexible plastic and consequent flexibility of the dome-shaped cap portion 38 forms a key feature of the present invention.

The cap 18 forms a snap-fit on the cylindrical portion 50 and the flexible construction of the dressing chamber insert 16 in combination with the rim 56 and provides a fluid-tight seal between the cap 18 and the dressing chamber insert 16. The cap 18 includes a ring 66 which fits around the cylindrical portion 50 and which is connected to the cap 18 by a flexible strap 68. An inner surface 70 of the cap 18 includes a shaft 72 which preferably is formed integrally therewith. The shaft 72 projects upwardly from the cap 18. An upper end 74 of the shaft 72 is disposed proximate to an inner surface 76 of the dome-shaped cap 38 portion of the dressing chamber insert 16.

Figure 3:
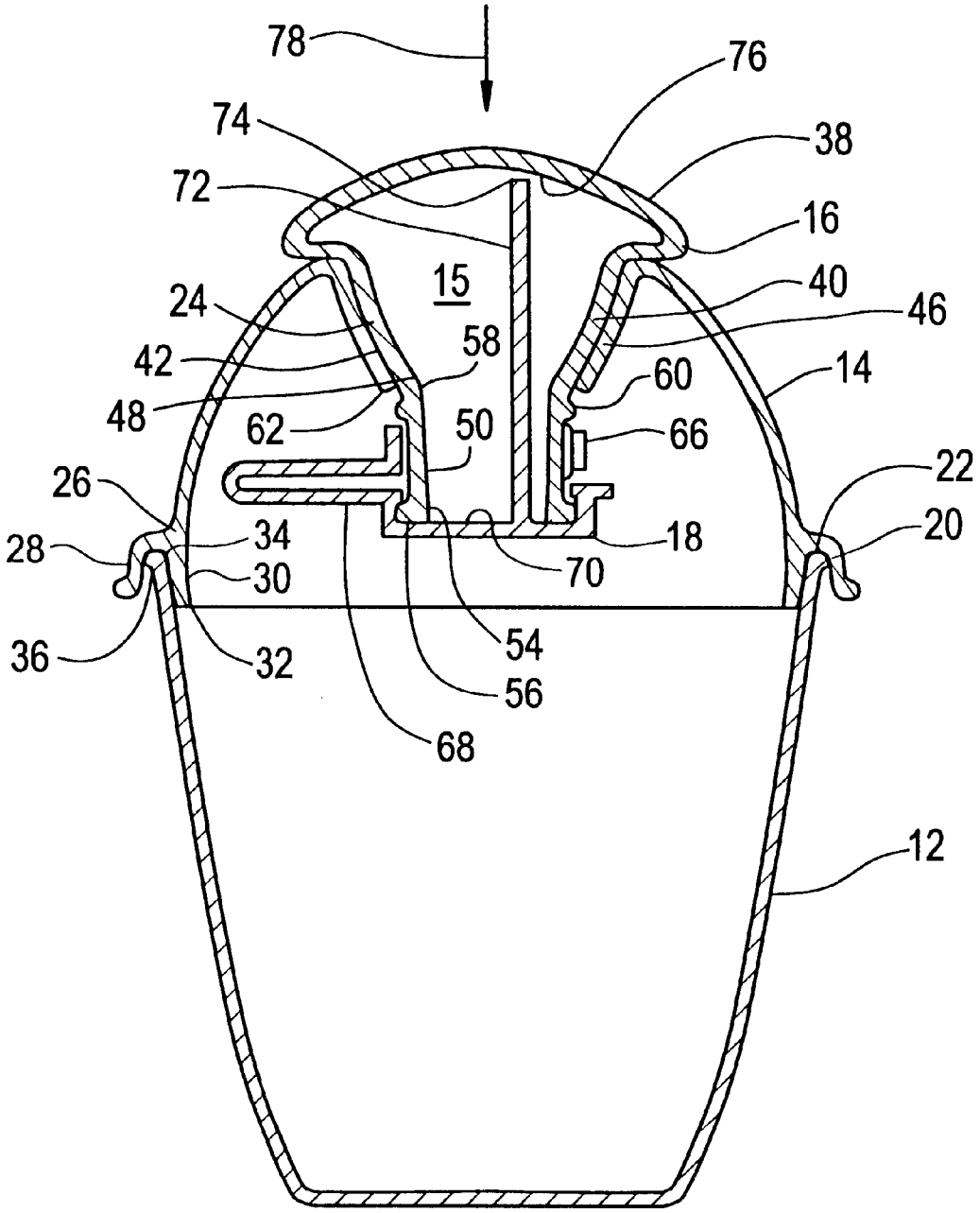
FIG. 3 is a cross-sectional elevational view taken along line 3—3 of FIG. 2.
Figure 4:
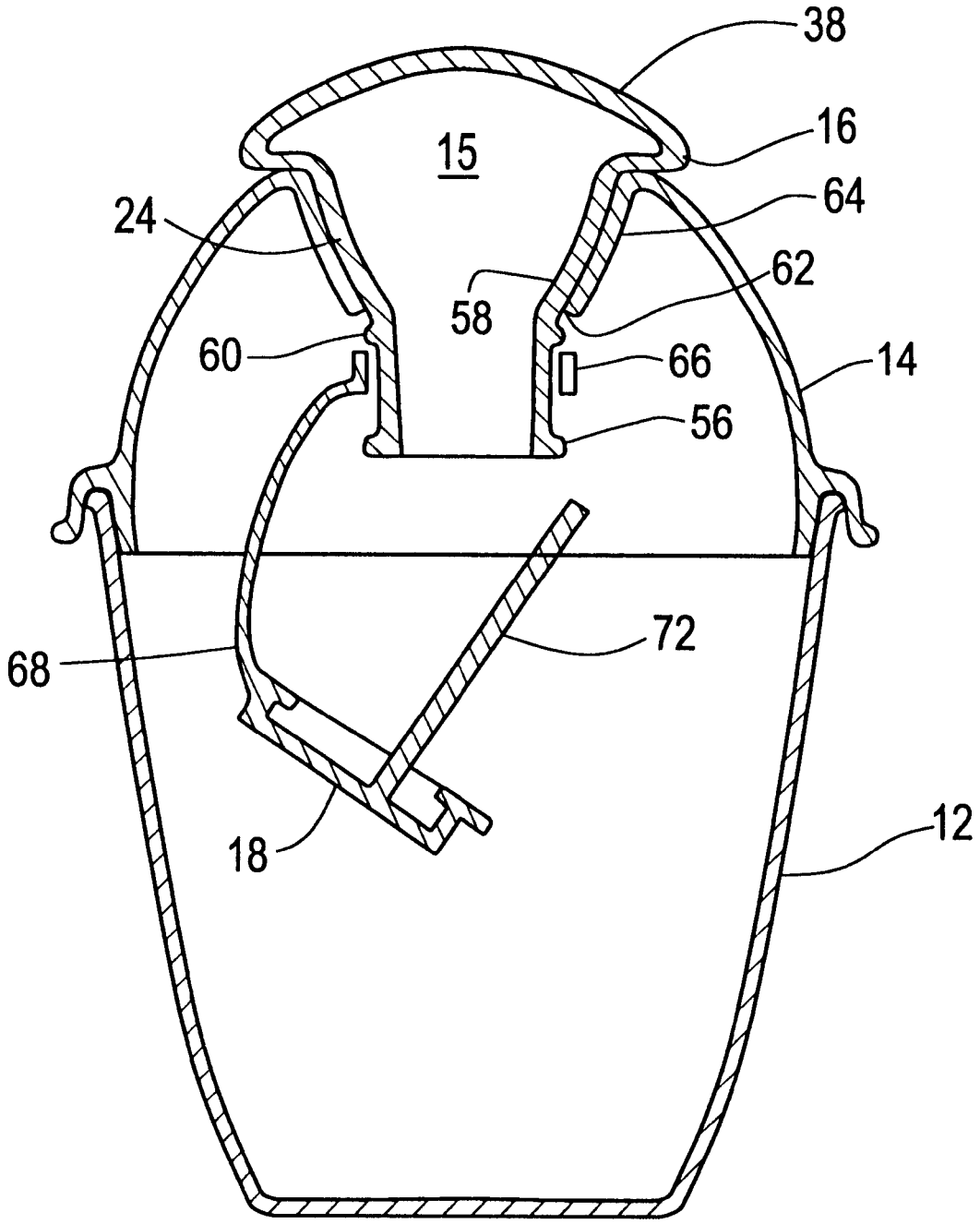
FIG. 4 is a cross-sectional elevational view similar to FIG. 3, showing the cap dislodged from the chamber insert.

Downward pressure on the dome-shaped portion 38 in the direction shown by the arrow 78 in FIGS. 1 and 3 causes the portion 38 to flex and come into contact with the end 74 of the shaft 72 and continued pressure dislodges the cap 18 from the dressing chamber insert 16, as shown in FIG. 4, thereby allowing contents of the cap 18, of the salad dressing, to flow out of the enclosure 15 of the dressing chamber insert 16 and onto contents of the container base 12, the salad ingredients.

During use, the container base 12 is filled with the salad ingredients. The enclosure 15 of the dressing chamber insert 16 is inverted and filled with salad dressing and the cap 18 is snap-fit onto the cylindrical portion 50. When it is desired to consume salad, the dome-shaped portion 38 is pressed in the direction indicated by the arrow 78 in FIGS. 1 and 3, thereby dislodging the cap 18 and allowing the salad dressing in the enclosure 15 of the dressing chamber insert 16 to flow onto the salad ingredients in the container base 12. The container is shaken, thereby allowing the salad dressing to coat uniformly the salad ingredients. The cover 14 is then removed, providing access by the user to the salad which can be eaten directly from the container base 12 or transferred to a plate, bowl or other article of holloware. In the preferred embodiment of the invention the cover 14 and the base 12 are made of a transparent or translucent plastic to permit observation of the salad ingredients.

Figure 5:
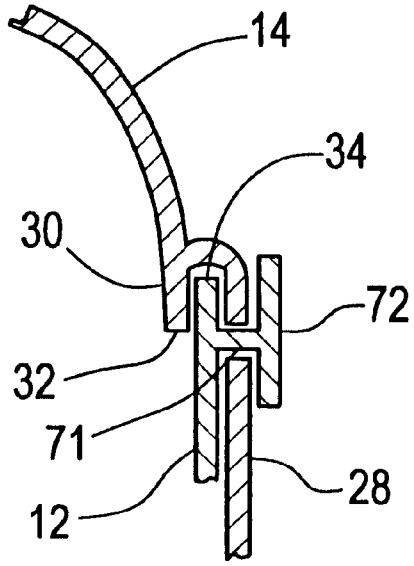
FIGS. 5 and 6 are detail views showing an alternate interlocking connection for a cover and base of the salad container.
Figure 6:
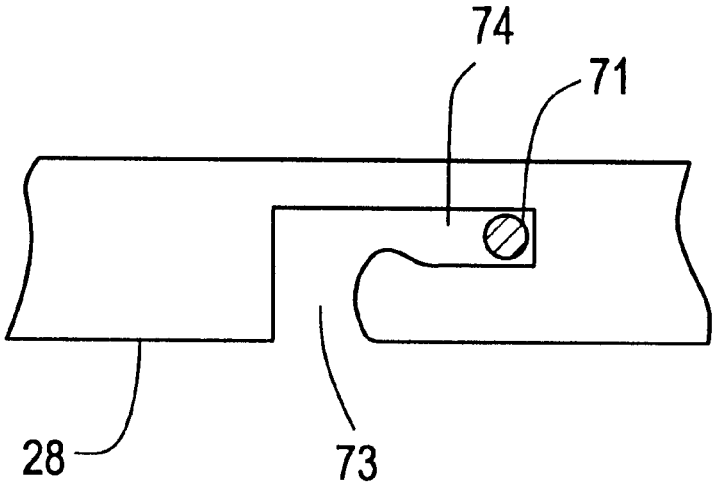

As shown in FIGS. 5 and 6, instead of the rim 28 and the skirt portion 30 cooperating to form a snap-fit seal between the container base 12 and the cover 14, an interlocked connection can be provided. The skirt portion 30 can be shortened with the edge 32 still guiding the cover 14 onto the container base 12. Studs 71 are arranged to project radially outwardly from the vicinity of the upper edge 34 of the container base 12. The studs are spaced at intervals about the periphery of the edge 34. The studs 71 support ears 72 spaced from the container base 12. Longitudinal openings 73 are provided in the outwardly projecting rim 28 which is spaced away from the skirt portion 30 with each of the longitudinal openings 73 arranged to receive a corresponding one of the studs 71. A transverse slot is formed in the rim 28 of the cover 14, each of the openings 73 corresponding to a slot 74 receiving one of the studs 71, whereby on rotating of the container cover 14 in a closing sense each of the studs 71 enters its corresponding slot 74 and each of the ears 72 engages with the rim 28 to hold the cover 14 onto the container base 12. To remove the cover 14 from the container base 12 the user rotates the cover in an opening sense, opposite to the closing sense, whereby each of the studs 71 is rotated to align with its corresponding longitudinal slots 73. Then the container cover 14 can be easily lifted from the container base 12 with each of the studs 71 exiting its corresponding slot 73.

The foregoing specific embodiments of the present invention as set forth in the specification herein are for illustrative purposes only. Various deviations and modifications can be made within the spirit and scope of this invention, without departing from the a main theme thereof.

I claim:

1. A salad container comprising:

a base member, with said base member having the general shape of a cup, and with said base member having an upper edge;

a cover member with said cover member mounted removably on said upper edge of said base member, with said cover member having an inwardly directed hollow portion projecting toward said base member;

a chamber insert defining an enclosure and mounted on said cover member and having a portion projecting into said inwardly directed hollow portion of said cover member, with said chamber insert having an opening directed toward said base member and having a flexible central portion;

a cap member removably sealing said chamber member with said cap member having a projecting portion directed toward said central portion of said chamber insert whereby pressure directed by a user on said central portion causes said central portion to deflect and bear on said projecting portion of said cap member and causes said cap member to open said chamber insert releasing salad dressing therefrom onto salad ingredients in said base member.

2. The salad container as claimed in claim 1, wherein said inwardly directed hollow portion of said cover member has a funnel shape.

3. The salad container as claimed in claim 2, wherein said funnel shape is provided with a concave wall.

4. The salad container as claimed in claim 1, wherein said projecting portion of said chamber insert has a funnel shape complementing said inwardly directed portion of said cover member.

5. The salad container as claimed in claim 1, wherein said projecting portion of said cap comprises a shaft member.

6. The salad container as claimed in claim 1, wherein said cover member has a dome shape.

7. The salad container as claimed in claim 1, wherein said projecting portion of said chamber insert further comprises a hollow cylindrical portion connected to said funnel-shaped portion.

8. The salad container as claimed in claim 7, wherein said cap further comprises:

a ring mounted on said cylindrical portion; and a flexible strap connecting said ring to said cap.

9. The salad container as claimed in claim 1, wherein said chamber insert is made of a flexible plastic material.

10. The salad container as claimed in claim 7, further comprising a retaining rim formed on said cylindrical portion and disposed adjacent said funnel shaped portion of said chamber, with said retaining rim engaging said cover member and preventing removal of said chamber insert from said cover member.

11. The salad container as claimed in claim 7, wherein said cap and said cylindrical portion form a snap-fit closure.

12. The salad container as claimed in claim 1, wherein said base member and said cover member form a snap-fit closure.

13. The salad container as claimed in claim 1, wherein said chamber insert comprises a dome-shaped central portion.

14. The salad container as claimed in claim 1, wherein said cover member further comprises a lower edge with said lower edge removably engaging said upper edge of said base member.

15. The salad container as claimed in claim 14, wherein said lower edge further comprises:

a rim portion;

a skirt portion with said rim portion spaced away from said skirt portion and defining a space therebetween with said upper edge of said base member disposed between said skirt portion and said rim portion.

16. The salad container as claimed in claim 15, wherein said skirt portion comprises a lower edge with said lower edge projecting beyond said rim portion.

17. The salad container as claimed in claim 15, and further provided with a plurality of studs each projecting radially outwardly from the upper edge of the container base with the studs spaced at peripheral intervals about the upper edge, each of the studs supporting an ear spaced outwardly of the outwardly projecting rim, a plurality of longitudinal openings each formed in the outwardly projecting rim and each corresponding to one of the studs, the outwardly projecting rim also forming a plurality of transverse slots each communicating with one of the longitudinal openings;

whereby when the studs are inserted longitudinally into the longitudinal openings and the container cover is rotated in a closing sense relative to the container base each of the studs enters into its corresponding transverse slot so that its corresponding ear engages over the outwardly projecting rim to hold the container cover onto the container base, and whereby on rotating the container cover in an opening sense opposite to the closing sense relative to the container base each of the studs is aligned with its corresponding longitudinal opening and, whereby when the container cover is then moved longitudinally relative to the container base, the container cover is separated therefrom.

* * * * *